US006052922A

United States Patent [19]

Bleck

[11] Patent Number: 6,052,922

[45] Date of Patent: Apr. 25, 2000

[54] SNOWSHOE WITH A LONGITUDINAL OPENING

[76] Inventor: James H. Bleck, 58 High St., Chelmsford, Mass. 01824

[21] Appl. No.: 09/339,285

[22] Filed: Jun. 23, 1999

Related U.S. Application Data

[63] Continuation-in-part of application No. 08/993,221, Dec. 18, 1997, abandoned.

[51] Int. Cl.[7] ..... A43B 5/04

[52] U.S. Cl. ..... 36/124; 36/125

[58] Field of Search ..... 36/122, 123, 124, 36/125

[56] References Cited

U.S. PATENT DOCUMENTS

| | | | |
|---|---|---|---|
| 2,738,596 | 3/1956 | Walsh | 36/4.5 |
| 3,299,541 | 1/1967 | Snyder . | |
| 3,600,829 | 8/1971 | La Violette | 36/4.5 |
| 3,638,333 | 2/1972 | Sprandel . | |
| 3,861,698 | 1/1975 | Greig | 280/11.13 |
| 4,045,889 | 9/1977 | Woolworth . | |
| 4,351,121 | 9/1982 | Wallace | 36/125 |
| 4,720,927 | 1/1988 | Abegg | 36/122 |
| 5,014,450 | 5/1991 | McGrath . | |
| 5,469,643 | 11/1995 | Forrest | 36/172 |
| 5,542,197 | 8/1996 | Vincent . | |
| 5,659,981 | 8/1997 | Liautaud . | |
| 5,682,688 | 11/1997 | Gallay . | |
| 5,720,120 | 2/1998 | Smith . | |
| 5,740,621 | 4/1998 | Wing et al. . | |

FOREIGN PATENT DOCUMENTS

| | | |
|---|---|---|
| 634114 | 1/1962 | Canada . |
| 2409066 | 7/1979 | France . |

*Primary Examiner*—Ted Kavanaugh

*Attorney, Agent, or Firm*—Rita M. Rooney; Cesari and McKenna, LLP

[57] ABSTRACT

An improved snowshoe is provided which is composed of a semi-rigid plastic web base which has a toe area having a downwardly extending flange encompassing a toe hole. The web base has a heel deck which has a raised retaining wall for maintaining the user's heel in the heel deck to reduce left or right sideslipping. A longitudinal slot is disposed between the toe hole flange and the heel deck. The slot relieves stresses along the web base during a walking motion by the wearer. A binding assembly may include a binding unit and tongue member which are connected to form a flexible two-piece hinge which allows both the user's toe to depress into the toe hole and the snowshoe web to fall away from the wearer's heel as the wearer bends his/her foot in a walking or running motion. A one piece, easy-to-use lace fastening mechanism is also provided to hold the binding assembly in tight engagement with the wearer's boot or shoe. The lace fastening mechanism may include a one-way locking channel which allows the lace to be adjusted while resisting loosening of the lace. Cleats may be provided on the underside of the web for use in icing conditions.

22 Claims, 5 Drawing Sheets

SNOWSHOE WITH A LONGITUDINAL OPENING

CROSS REFERENCE TO RELATED APPLICATION

This application is a continuation-in-part application of prior nonprovisional, U.S. patent application Ser. No. 08/993,221, filed on Dec. 18, 1997 now abandoned.

FIELD OF THE INVENTION

This invention relates generally to improved snowshoes and, specifically, to a low-cost snowshoe having an improved construction, shape and binding clasp which provides for, inter alia, increased durability and advantageous gripping action.

BACKGROUND OF THE INVENTION

A variety of designs, construction, and materials have been known and described for snowshoes. Conventionally, snowshoes were constructed of a generally elliptical wooden frame threaded with a cross-hatched web to which the wearer's boot would be secured. Such a snowshoe provides flotation to resist against the walker sinking too deeply in the snow, but is relatively heavy.

Typically, a snowshoe includes a toe hole to accommodate the toe portion of the wearer's foot while walking. A binding is mounted on the snowshoe web to secure the wearer's boot to the snowshoe. The binding wraps around the instep portion of the wearer's boot to secure the snowshoe to the foot. In addition, a hinge is often provided on the binding at the toe hole to allow the toe of the wearer's boot to rotate into the toe hole of the snowshoe to correspond to a normal walking motion.

The conventional wooden frames require substantial upkeep due to the wet conditions in which the snowshoes are used. Thus, they present problems with durability. As a result, more recently developed snowshoes have been composed primarily of a combination of materials including a frame of aluminum tubing with a plastic web. Such materials are lighter weight and have better durability with less upkeep, but the various parts can require complex assembly. Both these materials and the manufacturing requirements lead to a more expensive product.

In addition, some prior art designs use metal, such as aluminum, for the binding mounting and for a hinge at the toe hole. These parts can be very expensive to manufacture and assemble. Moreover, certain bindings and hinge constructions place a repeated stress on the underlying parts of the snowshoe, thus, lessening the durability of the shoe. See e.g., U.S. Pat. No. 5,014,450 (McGrath). In addition, the fasteners or buckles provided to secure the bindings in place over the wearer's shoe in some prior designs can be cumbersome and make taking the snowshoe on or off difficult.

It is also important in snowshoe design to provide a gripping action by the shoe into the snow for uphill walking or in traversing the side of a mountain.

Another aspect of snowshoeing that needs to be addressed in the design of the snowshoe is that of sideslipping of the snowshoer's heel. Some prior designs use a tight strap to hold the heel in place but this can reduce the effectiveness of the snowshoe because it reduces the ability of the shoe to rotate and fall fully away from the snowshoer's heel while the snowshoer walks.

Yet a further issue involves the mechanism for securing the snowshoe to the wearer's boot. The fastening device used in prior designs that locks the binding mechanism in place typically includes a strap and buckle or a plastic, two-piece clasp which can become loosened while in use. Further, such types of fastening devices are difficult to open to re-adjust or to open in order to remove the snowshoes, particularly when the user is wearing gloves or mittens and when the device becomes covered with snow and ice. The clasps of prior designs can thus be difficult to work with or, at the very least, inconvenient for the user. These problems are accentuated when the users of the snowshoes are children.

There remains a need, therefore, for an improved snowshoe of comparatively low cost which solves the problems encountered with prior designs in the areas of ease of manufacture, increased durability, lightness of weight and efficiency during walking in a variety of weather conditions and terrain, and ease of putting the shoes on and removing them, particularly with respect to products designed for children who may be wearing mittens and outer wear.

It is thus an object of the invention to provide a snowshoe having superior gripping action and flotation behavior as well as having a simple-to-use binding which can also be comprised of plastic to reduce deterioration and other wear and which can relieve the stresses encountered upon repeated flexing of the snowshoe. In addition, there remains a need for a snowshoe which has a design which will distribute the stresses across a maximum portion of the snowshoe.

It is yet another object of the present invention to provide a low cost snowshoe which is light-weight, simple to manufacture and has increased durability, good performance in a variety of conditions and terrain, and has a binding and fastening mechanism which is both sturdy, but simple to put on and remove in cold weather conditions.

SUMMARY OF THE INVENTION

These and other needs are satisfied by the improved snowshoe of the present invention which is a low-cost snowshoe including a web of semi-rigid plastic. The snowshoe has a generally elliptical shape with an elongated tail portion and it has a unique toe area at one end connected by a bridge to a heel deck. A downwardly extending perimeter flange encompasses the entire shoe.

The toe area has an internal downward flange which defines a toe hole through which the ball of the wearer's foot can depress during a walking or running motion. The flange is continuous around the hole except for a longitudinal slot which extends from the toe hole flange back through a bridge area in the web toward the heel deck. The slot allows flexing across the web to relieve undue stresses across the web. Both the toe area flange and the slot can optionally be provided with downwardly extending teeth for additional grip in the snow.

The heel deck is an enclosed horseshoe-shaped portion of the snowshoe which includes several internal downwardly extending flanges that provide increased gripping into the snow particularly in traversing across the side of a mountain. A raised retaining wall positioned around the circumference of the heel deck area helps to reduce slippage of the wearer's heel toward the left and right while walking, without requiring that the wearer's heel be strapped down onto the snowshoe.

The snowshoe is secured to the user's boot ("boot" as used herein can also include a shoe or other footwear item) by means of a binding which is formed of a semi-rigid plastic. The binding has a butterfly shape which folds around the instep area of the wearer's boot. Preferably, it is fastened by laces which are simple to use, remain reliably secure, and allow for ease of putting on and removing the snowshoes. The laces are also economical. Alternatives to the laces include straps, webbing and buckles, but the presently preferred embodiment has laces for the reasons stated.

The preferred embodiment of the invention also includes a unique lace fastening mechanism that is a single piece of molded plastic into which laces are threaded. A hook and one-way locking device, which form part of the lace fastening mechanism, maintains the laces in place to provide securement of the binding to the wearer's boot. The binding can also readily accommodate many different shoe or boot styles and sizes, and can be used by children.

In accordance with one embodiment of the invention, the binding may be connected to the snowshoe by means of a plastic tongue portion which is mounted directly on the bridge between the toe hole and the heel deck area. The binding and tongue comprise a two-piece hinge which also allows the snowshoe to rotate and fall away from the user's heel as he/she walks. This provides flexibility to allow the toe to depress into the toe hole when the user bends his or her foot and which provides increased flexibility without undue stress on the remaining portions of the snowshoe and the binding. In the embodiment of the invention for children's sizes, the tongue portion may be omitted as unnecessary due to the lower stresses applied by a lighter weight user.

An optional strap can be provided on the underside of the shoe along the bridge between the toe hole and the heel deck. The strap can be used to help to limit undue flexing across the slot. Cleats may be adhered to the strap to provide additional gripping action in icing conditions.

BRIEF DESCRIPTION OF THE DRAWINGS

For a fuller understanding of the nature of the invention, reference should be had to the following detailed description taken in connection with the accompanying drawings, of which.

DETAILED DESCRIPTION OF THE PREFERRED EMBODIMENTS

Figure 1:
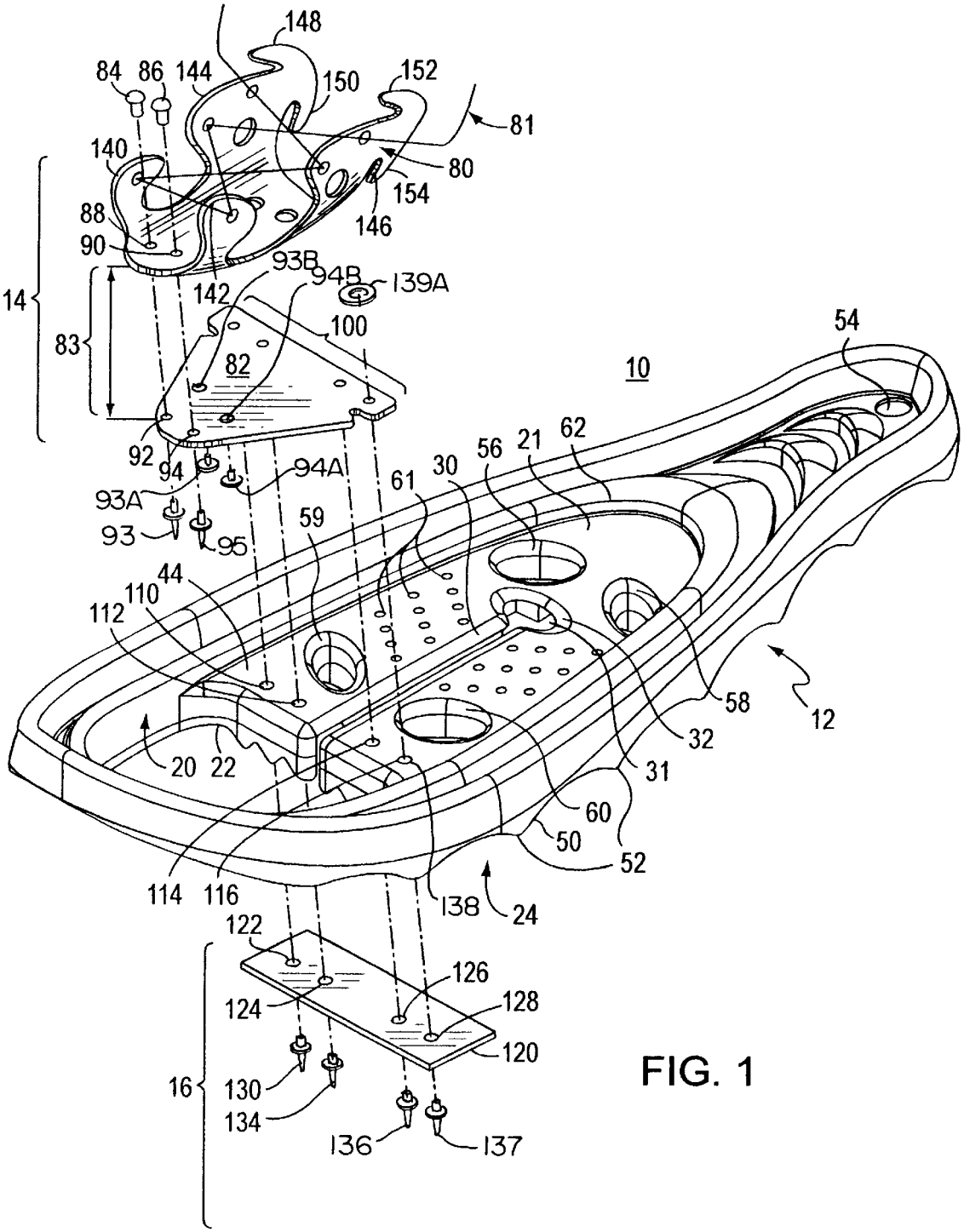
FIG. 1 is an exploded elevational view of the snowshoe web as well as the binding and cleating components of the present invention.

FIG. 1 illustrates a snowshoe 10 embodying the invention which has as a base a snowshoe web 12, to which a binding assembly 14 and strap and cleat assembly 16 are attached.

Figure 2:
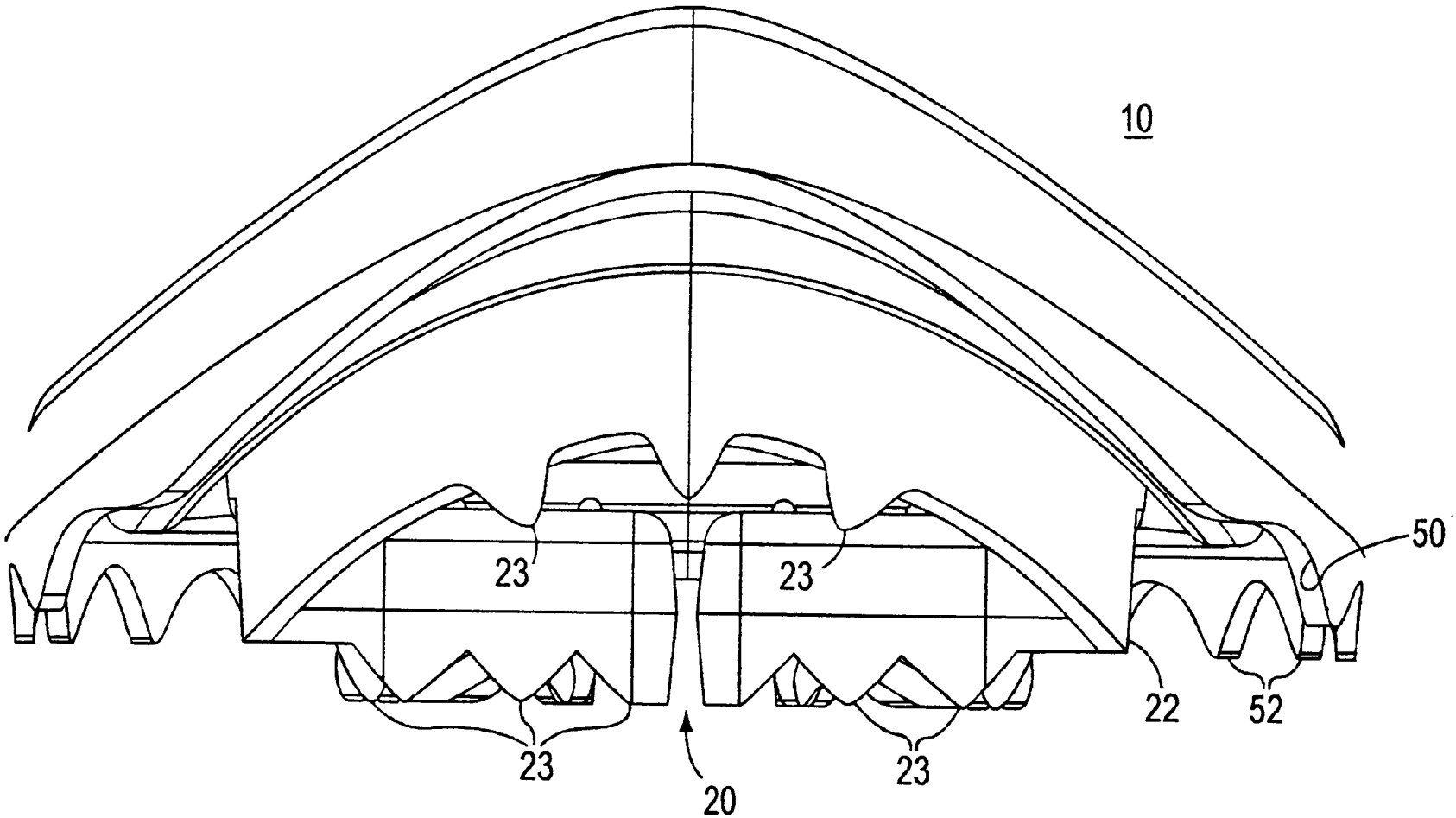
FIG. 2 is a front plan view of the toe portion of the snowshoe web of the present invention.

The snowshoe web 12 has toe hole area 20 and a heel deck 21 which together form a footprint upon which the wearer's boot can be placed and secured by binding assembly 14. The toe hole area 20 is encompassed by a downwardly extending toe hole flange 22. The toe hole flange 22 can be seen more readily in FIG. 2 which shows a front plan view of the toe portion of the snowshoe 10. The toe hole flange 22 provides the user with a firm grip into the snow, especially when stepping into a hill. The toe hole flange 22 is optionally provided with teeth 23 as shown in FIG. 2, for additional gripping action into snow and ice. The opening of the toe area 20 allows passage of the toe portion of the user's boot through the toe hole, while running or walking.

It is also preferred to provide an upward curve 23 (FIG. 1) in the toe hole end of the snowshoe 10. This curve 24 also helps with stepping into the snow in an uphill climb.

Figure 3:
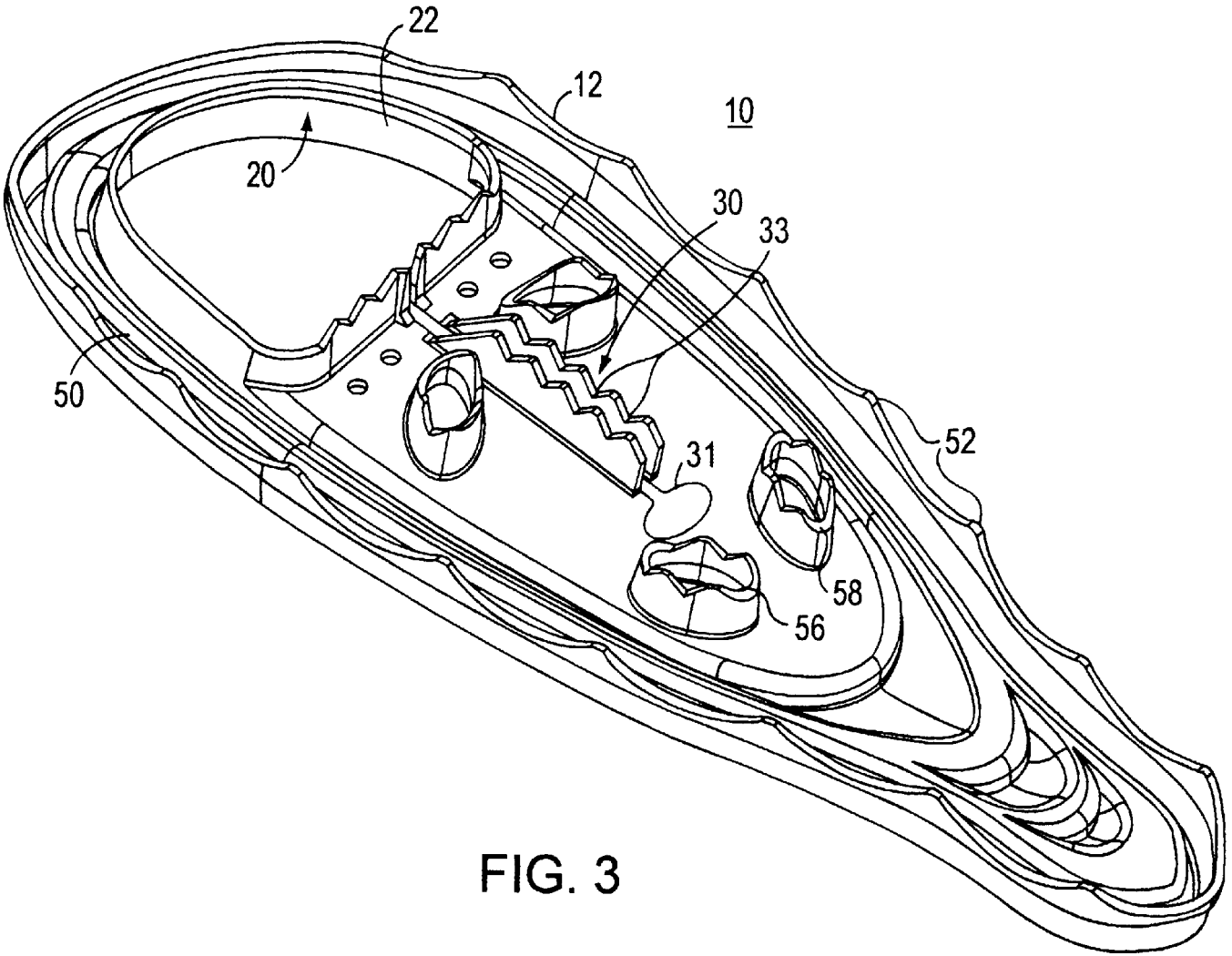
FIG. 3 is an elevational view of the bottom of the snowshoe web of the present invention.

Referring again to FIG. 1, the snowshoe 10 is also provided with a longitudinal slot 30. The slot 30 extends from the toe hole flange 22 through a bridge area 44 back into the heel deck 21. At one end of the slot 30, there is an oval opening 31 encompassed by its own flange 32. The slot 30 with oval opening 31 allows the plastic of the web 12 to flex downwardly and outwardly during a downward step. The slot 30 allows an even distribution of stress during use. These stresses are applied as discussed herein when the wearer places the most weight, through the binding and tongue assembly 14, upon bridge area 44 while walking. Referring to FIG. 3, the bottom of the snowshoe 10 is illustrated. As best shown in FIG. 3, the slot 30 can optionally be provided with downwardly extending teeth 33 to help in pushing the flanges into the snow as the user walks, to provide improved gripping action.

Referring now again to FIG. 1, the toe hole area 20 of the web 12 is connected by the bridge area 44 to the heel deck 21. The heel deck is a horseshoe-shaped, generally flat area on the web 12 which has several internally-disposed flanges 56 and 58 positioned towards the back-end of the heel deck 21. The flanges 56 and 58, which are also visible in FIG. 3, provide additional gripping in the snow. The flanges 56 and 58 provide additional grip especially on downhill walking.

The heel deck 21 is encompassed by a raised retaining wall 62 which surrounds the entire heel deck 21. The raised retaining wall 62 is preferably formed within the plastic and it reduces left and right sliding of the user's heel, while allowing the user to lift his/her heel off the snowshoe 10 while walking. This is in contrast to prior designs which attempt to reduce left and right sliding by providing a tight strap across the heel. Such a strap, however, does not allow the shoe to fall fully away from the user's heel while walking.

Referring to all of the figures, the snowshoe web 12 has a perimeter flange 50 surrounding its entirety. Perimeter flange 50 is designed to urge snow inward and provide additional flotation for walking in powder snow. In addition, the flange 50 also contains teeth 52, such as those designated generally by reference character 52, provided in an HDPE (high-density polyethylene) plastic material. These teeth 52 are preferably sharp teeth components, which will provide a firm grip in the snow. The teeth 52 as shown in FIGS. 1 and 3 are in a scalloped configuration, however, the teeth could be more closely spaced, or more widely disposed than that shown, while remaining within the scope of the present invention. Hanging hole 54 is optionally provided in the web 12 for the user's convenience.

Between the bridge area 44 and the heel deck 21, there are two additional circular flanges 59 and 60. When the user walks, these circular flanges 59 and 60 are depressed by the ball of the wearer's foot and they act as cleats to provide extra grip in snow and in icing conditions. Circulation holes designated generally by reference character 61 allow for air and water to pass through the web 12 to reduce moisture or ice build-up on the web 12.

The boot of the snowshoe wearer is secured to the snowshoe by means of a binding assembly 14. One embodiment of the binding assembly 14 is illustrated in FIG. 1. The binding assembly 14 includes a butterfly shaped binding portion 80 and a flat tongue ember 82. The binding 80 is secured to tongue member 82 by means of suitable fasteners 84 and 86, which may be nut-and-bolt assemblies, or rivets, passed through holes 88 and 90 which are aligned with corresponding holes 92 and 94 in the tongue member 82.

The combination of the butterfly binding 80 and the tongue member 82 form a flexible two-piece hinge 83 allowing the wearer's boot (not shown) to rotate into the toe hole 20 in the snowshoe 10 and allows the snowshoe 10 to fall away from the wearer's heel when the foot is bent and lifted in a normal walking or running motion. The flexible hinge provided by the binding 80 and the tongue member 82 also relieves stresses across the underlying bridge member 44 of the web 12. The flexible two-piece hinge as formed by the butterfly binding 80 and the tongue member 82 is an alternative to prior designs which use a mechanical hinge component of several metal parts requiring complicated assembly. As noted, in a child's version of the snowshoe 10, tongue member 82 can be omitted, if desired.

The tongue portion 82 is mounted onto the bridge area 44 of web 12 by means of spike rivets 130, 134, 136 and 137, passed through holes in the tongue portion 82 which holes are designated generally by the reference character 100. The spike rivets 130–137 are then passed through correspondingly aligned holes 110 through 116 in bridge area 44 of the web 12. The end of the spike rivets, such as the rivet 137, which is passed through the hole 139 in the tongue 82, is capped off by component 139A. A similar assembly is provided for each spike rivet.

The spike rivets 130–137 not only securably mount the tongue member 82 onto the bridge area 44, but also provide gripping action for frozen snow and icing conditions. The rivet assembly allows the flexing downward of the tongue upon the downward step of the wearer while further allowing the hinging action of the butterfly binding unit 80 when the wearer's foot is bent during a walking motion. An optional backing plate 120 which may be comprised of a rigid plastic material similar to that which web 12 is comprised can be attached by the spike rivets. The backing plate 120 strengthens the bridge area 44 and also provides a component to which the spike rivets and any optional cleats may be adhered. The backing plate 120 helps to limit the opening and flexing of slot 30 to reduce undue flexing across the slot yet allows some flexing for the advantages described herein.

If desired in certain weather conditions, or for certain types of terrain, the snowshoe 10 may include a conventional strap and cleat assembly (not shown) which either replace the spike rivet assembly or may be used in addition to it for certain weather conditions and/or terrain. For additional gripping action, spike rivets 93 and 94 can be provided in the tip of the tongue 82 through holes 92 and 94, respectively.

As noted herein, the wearer's boot is secured to the snowshoe using binding assembly 14. The binding unit 80 is formed of a flexible piece of plastic and has a butterfly shape with flaps 140 and 142 to encompass the wearer's toe area and larger flaps 144 and opposing flap 146 which encompass the instep area of the wearer's foot. Flap 144 has extensions comprising ears 148 and 150 and, similarly, flap 146 has extensions comprising ears 152 and 154. Other configurations for binding unit 80 may be used while remaining within the scope of the present invention.

Figure 4:
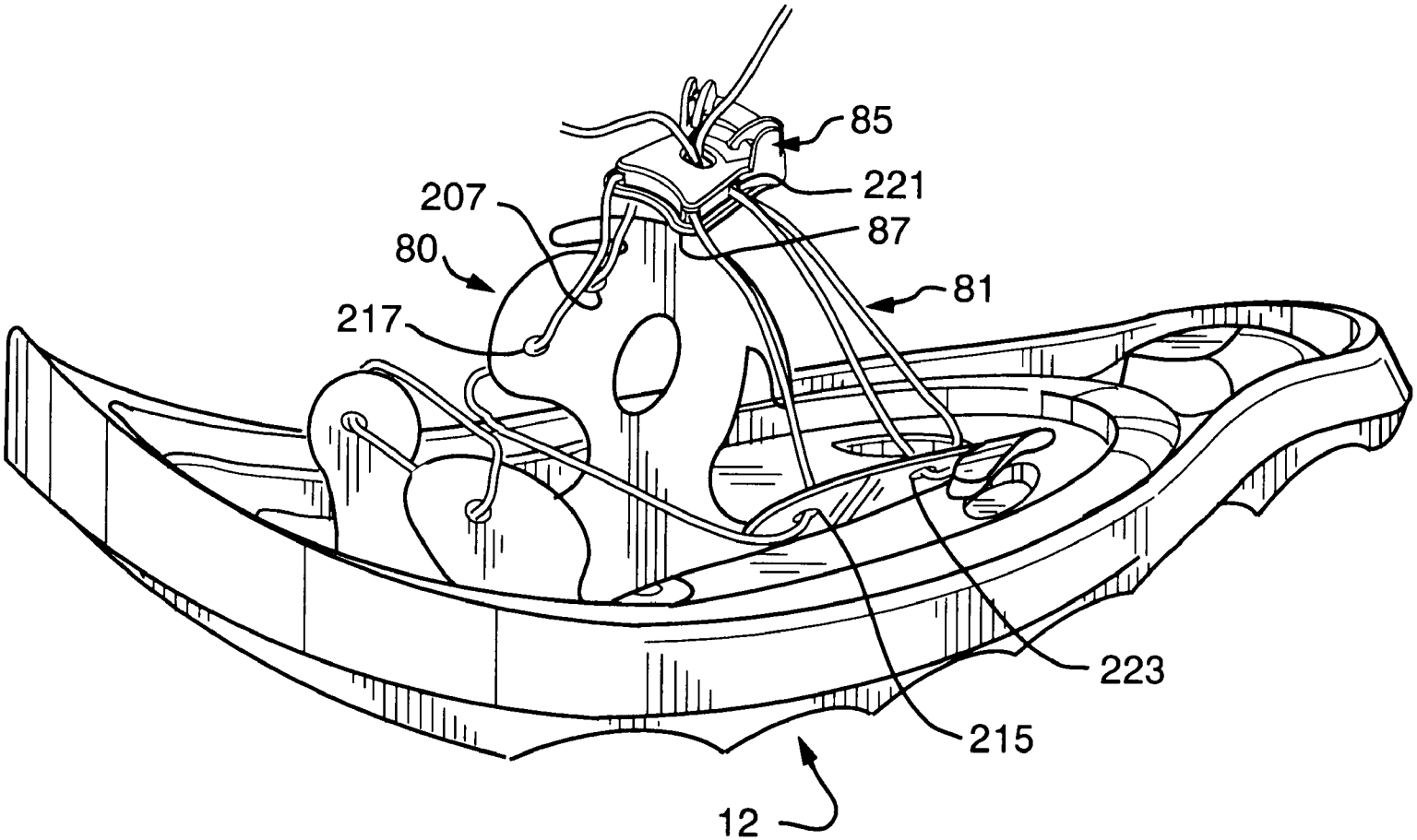
FIG. 4 is an isometric view of one embodiment of the snowshoe illustrating the lace fastening mechanism of the present invention.
Figure 5:
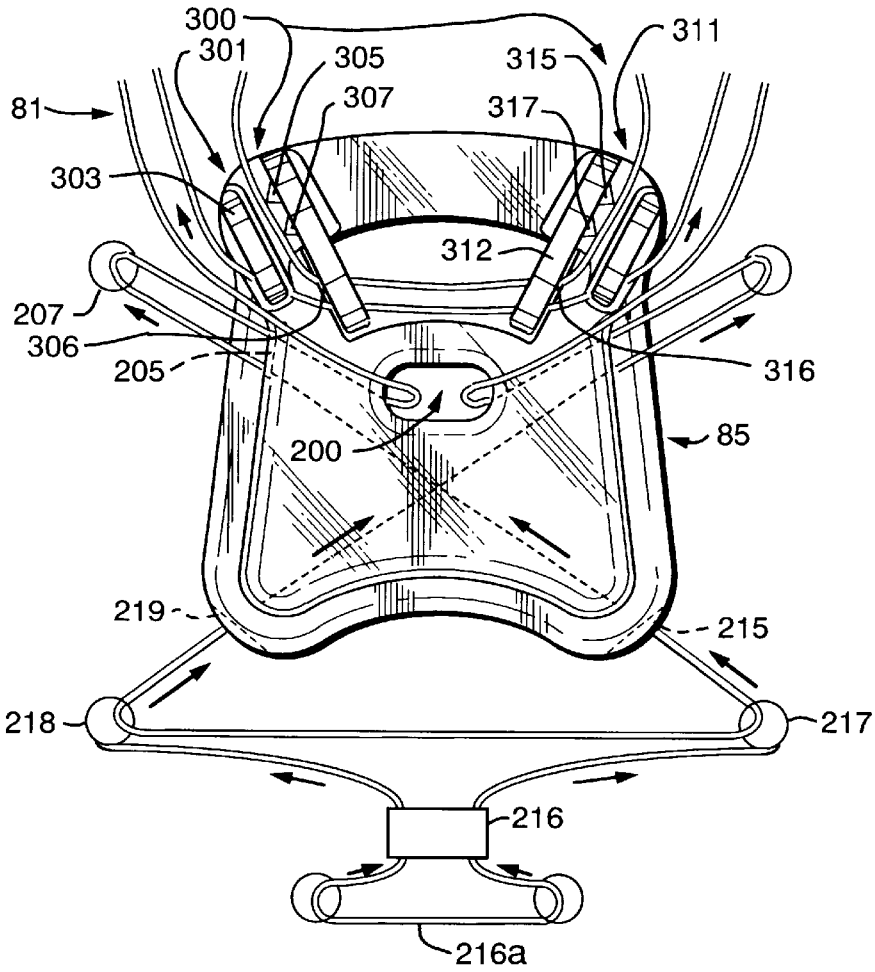
FIG. 5 is a top plan view of the lace fastening mechanism and locking device of the present invention.

Referring now to FIGS. 4 and 5, a lace 81 and lace fastening mechanism 85 secure the binding unit 80 to the wearer's boot (not shown). The lace fastening mechanism 85 is a single piece of molded plastic as illustrated in FIG. 5. A lace 81 is threaded through an opening 200 that is generally in the center of the lace fastening mechanism 85. The lace 81 is wound underneath the plastic lace fastening mechanism 85 and passed through an opening 207 in the binding member 80. The opening 207 is illustrated schematically in FIG. 5, but is illustrated on the binding member 80 in FIG. 4. The lace 81 is then crossed back through the lace fastening mechanism 85 and exits the lace fastening mechanism 85 through an opening 215. It is then threaded back into an opening 217 in the binding member 80. Preferably, the lace 81 is passed through a lace lock fastener 216 to provide additional securement as shown in FIG. 5. Ultimately, the lace 81 is passed back across the binding member 80 through an opening 218. It is then crossed back into the lace fastening mechanism 85 through an opening 219. The lace 81 is then threaded back across the lace fastening mechanism 85, out through another opening 230 in the binding member and finally through the center opening 200.

Preferably the loose ends of the lace 81 are then extended back through the central opening 200 into the direction of the user's heel. The loose ends are wrapped around the user's heel (not shown). The ends are brought forward to the user's instep area and are strung through the locking device 300. More specifically, a one-way locking device 300 is comprised of channels 301 and 311. The locking device 300 has a channel 301 which includes a first channel member 303 and a second channel member 305. The locking device 300 also contains a hook and teeth on the channel members, such as the hook 306 and tooth 307 on channel member 305 which maintain the lace 81 in place by allowing the lace 81 to be tightened in one direction but which will not allow the lace to slip or pass in the other direction.

Figure 6:
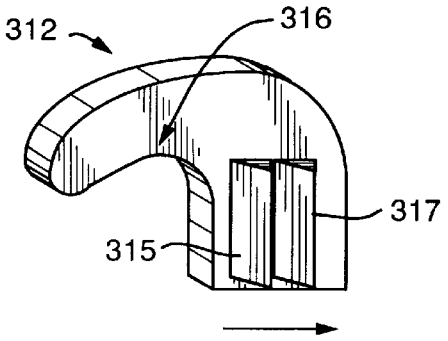
FIG. 6 is a side elevation of one channel wall of the locking device of the present invention.

The teeth on the channel 311 of the locking device 300 are further illustrated in FIG. 6. The teeth 315 and 317 are formed on one surface of the channel member 312. The teeth 315 and 317 have a prism-like shape which shape allows the lace 81 to be pulled and tightened in the direction of the arrow (FIG. 6) but which shape does not allow the lace 81 to move (loosen) in the opposite direction. The hook 316 forms a stabilizer against which the lace 81 can be anchored for tightening before it is then forced down into the channel 311 to lock the lace 81 in place. The lace 81 will thus stay in place without the need for additional adjustment and can be tightened by a simple tug on the lace fastening mechanism 85. Even a user who is wearing gloves or mittens can readily accomplish this.

The lace 81 and the lace fastening mechanism 85 provide adequate holding strength, yet they are easy- to- use. A variety of lacing patterns may be readily adapted to binding unit 80 while remaining within the scope of the present invention, but a preferred embodiment of the invention includes the lacing pattern depicted in FIG. 5 as illustrated by the arrows. Alternatives can also be used while remaining within the scope of the present invention.

The snowshoe 10 can be readily adapted for production in a range of sizes from children's sizes to adult's snowshoes. The snowshoe web 12 is preferably formed from a single sheet of plastic, preferably by a low cost injection molding process. Alternatively, the web 12 may be formed by stamping an aluminum or stainless steel sheet, or, the web 12 can be formed by a thermo-forming process. The binding unit 80 and the tongue 82 are preferably die cut from a single sheet of flexible plastic, or those components can be formed by injection molding.

It should be understood that the improved snowshoe embodying the present invention provides a low cost solution to the existing design problems in that the snowshoe is easy-to-use, and provides increased effectiveness in a variety of terrain and conditions and increased durability. It is simple to manufacture because the entire web, as well as the lace fastening mechanism consists of a single piece of plastic, or an alternative material, and very little assembly is required.

It should also be understood that while a preferred embodiment of the invention includes the lace fastening mechanism as used with the snowshoe of the present invention, the lace fastening mechanism is equally applicable to other items which require a lace fastener such as backpacks, outerwear, snow boards and the like.

The terms and expressions employed herein are used as terms of description and not of limitation and there is no intention in the use of such terms and expressions, of excluding any equivalents of the features shown and described or portions thereof, but it is recognized that various modifications are possible within the scope of the invention claimed.

What is claimed is:

1. A snowshoe for securing to a user's boot, with the boot having a toe portion and an opposite end, the snowshoe comprising:

(A) a base having a forward toe area and a centrally-located heel deck area, with said toe area having a toe hole opening positioned to receive said toe portion of said user's boot, said toe hole opening being encompassed by a downwardly extending toe hole flange, and said heel deck area being sized to receive said heel of the user's boot, and said heel deck area being centrally-split with a longitudinal opening extending from said toe hole flange towards the opposite end of the snowshoe and terminating in an elliptical opening for stress dissipation, whereby said centrally-split heel deck area provides for downward and outward flexing of said snowshoe heel deck area during a walking motion;

(B) a perimeter flange encompassing an outer perimeter of said snowshoe; and (C) a binding assembly attached to said base, said binding assembly having securing means for holding said boot of said user to said binding assembly.

2. The snowshoe of claim 1 wherein said binding assembly includes:

(A) a binding unit configured to engage and partially enclose the toe portion of said user's boot; and (B) a tongue member having a (1) first fastening means for securement of said tongue member at one end to said binding unit; and (2) a second fastening means for securement of said tongue member to said base of said snowshoe, said binding unit and said tongue member being flexible forming a dual action flexing means for permitting a first rotation of said user's foot such that said user's toe can pass into said toe hole opening and a second, further rotation upon said user's heel lifting from said heel deck area in such a manner that said snowshoe base falls away from said user's heel during a walking step.

3. The snowshoe of claim 2 wherein said binding unit and said tongue member are composed of a flexible, plastic material.

4. The snowshoe of claim 2 wherein said binding unit, and said tongue member are each formed from single pieces of semi-rigid plastics.

5. The snowshoe assembly of claim 2 wherein said securing means includes a single lace which wraps around said user's boot.

6. The snowshoe of claim 3 wherein said binding unit of said binding assembly has a pair of front flaps which engage the toe portion of the user's boot, and a pair of rear flaps which envelope an instep portion of the user's boot, said rear flaps each having at least one ear positioned to retain said lacing means securely around said binding unit and thereby around said user's boot.

7. The snowshoe of claim 1 further comprising a backing plate positioned on an underside of said base, adjacent said bridge portion.

8. The snowshoe of claim 1 wherein said second fastening means include spike rivets.

9. The snowshoe of claim 1 wherein said downwardly extending perimeter flange encompassing outer perimeter of said base is shorter than the downward extension of said toe hole flange such that said toe hole flange is depressed more deeply into snow during a walking motion than said perimeter flange is depressed.

10. The snowshoe of claim 9 wherein said heel deck area includes a plurality of downwardly extending flanges for gripping into snow which extend downward further than said perimeter flange.

11. The snowshoe of claim 10 wherein said flanges are sharp teeth.

12. The snowshoe of claim 1 wherein said heel deck area has a raised retaining wall extending upwardly and outlining the perimeter of said heel deck area whereby said wall maintains the heel of said user's boot within said heel deck area, reducing left and right sideslipping of the user's heel.

13. The snowshoe of claim 1 wherein said base is composed of an HDPE plastic material.

14. The snowshoe of claim 8 wherein said snowshoe is composed of an HDPE plastic material.

15. The snowshoe of claim 1 wherein said base is formed from a single piece of semi-rigid plastic.

16. The snowshoe of claim 1 wherein said central split in said heel deck area has downwardly extending teeth therein.

17. The snowshoe of claim 1 wherein said toe hole flange has downwardly extending teeth therein.

18. The snowshoe of claim 1 wherein said base and said binding assembly are formed in children's sizes.

19. The snowshoe of claim 1 wherein said securing means includes a lace fastening mechanism for securing a lace which holds said boot of said user to said binding assembly and which restricts movement of the lace in a direction in which the lace is loosened.

20. The snowshoe of claim 19 wherein said lace fastening mechanism is a single piece of molded plastic.

21. The snowshoe of claim 19 wherein said lace fastening mechanism includes a locking means that includes a first and second channel, each of said first and second channels including parallel members for receiving a lace therebetween, and at least one of said parallel members of each said channel having locking teeth disposed upon at least one of said members, said locking teeth allowing said lace to pass through in a first, tightening direction, but resisting movement of said lace in an opposite, loosening direction.

22. The snowshoe of claim 21 wherein the lace fastening mechanism also includes at least one hook means disposed on one of said channel members above said locking teeth for anchoring said lace while tightening adjustment before locking said lace down upon said teeth.

* * * * *